US005126912A

United States Patent [19]

Coville

[11] Patent Number: 5,126,912

[45] Date of Patent: Jun. 30, 1992

[54] STORAGE CABINET FOR PREVENTING ELECTROSTATIC CHARGE BUILDUP WITH FILTERING AND METHOD

[75] Inventor: Morris L. Coville, 2786 Joseph Ave., Apt. A, Campbell, Calif. 95008

[73] Assignee: Morris L. Coville, Corvallis, Oreg.

[21] Appl. No.: 488,675

[22] Filed: Mar. 2, 1990

[51] Int. Cl.[5] ..... H05F 1/00

[52] U.S. Cl. ..... 361/212; 361/215; 361/230

[58] Field of Search ..... 361/384, 212, 215, 230, 361/231

[56] References Cited

U.S. PATENT DOCUMENTS

| | | | |
|---|---|---|---|
| 4,477,263 | 10/1984 | Shaver et al. | 55/6 |
| 4,689,715 | 8/1987 | Halleck | 361/213 |
| 4,837,663 | 6/1989 | Zushi et al. | 361/384 |
| 5,010,777 | 4/1991 | Yehl et al. | 361/231 |

*Primary Examiner*—A. D. Pellinen
*Assistant Examiner*—Jeffrey A. Gaffin
*Attorney, Agent, or Firm*—Flehr, Hohbach, Test, Albritton & Herbert

[57] ABSTRACT

Storage cabinet for discrete articles for preventing electrical charge buildup with filtering comprising a box-like housing forming an enclosure and having a rear wall. Dividing walls are provided within the enclosure for forming a plurality of cells. Each of the cells has an opening facing forwardly from the rear wall and an openable door is provided for closing the opening of the cabinet and permitting access to the cell. Shelf supports are provided within each of the cells for receiving and carrying discrete articles which are introduced into the cells through the door of the cell. A plenum wall extends vertically in the rear of the cabinet and is spaced forwardly of the rear wall of the cabinet to provide a vertically extending plenum. Spacers are provided in the cabinet for providing a freeboard space extending vertically of the cabinet to the rear of the shelf supports and forward of the plenum wall. A blower and filter are provided for collecting air from within the enclosure in the cabinet and for supplying filtered air to the plenum at a positive pressure. Pairs of ionization emitters are mounted on the plenum wall and face inwardly into the freeboard space to emit positive and negative ions into the freeboard space. A power supply is provided for supplying power to the ionization emitters. The spacers include stops which are located in the freeboard space for preventing articles entering the freeboard space.

17 Claims, 2 Drawing Sheets

STORAGE CABINET FOR PREVENTING ELECTROSTATIC CHARGE BUILDUP WITH FILTERING AND METHOD

This invention relates to a storage cabinet for preventing electrostatic charge buildup with filtering and more particularly, to such a cabinet suitable for use in storing photomask reticle sets.

In the semiconductor industry it has been found that electrostatic discharge causes chrome to lift from photomask reticles. Electrostatic discharge damage increases photomask reticle costs in replacement and in lost production in a semiconductor facility. Attempts have been made to develop low cost solutions to limit electrostatic discharge damage to photomask reticles. Precision Inc. of San Jose, California 95111 provided a photomask reticle cassette storage cabinet. The ISYS-120 photomask cassette storage cabinet had a capacity for storage of 120 cassettes, 12 cassettes per compartment. Pulse DC ionization was used to neutralize static buildup in the cabinet within approximately 35 seconds without any air flow to assist ionization. Eight pairs of ionization emitters were used for the entire cabinet. However, it was found that hot spots developed in such cabinets. Other cabinets have also used ionization systems which have similar hot spot problems. Where the cabinet has multiple sections for reticle cassette storage, there has been a problem with even distribution of ionization throughout the cabinet. Since the cells were independent of each other, it has been difficult to achieve an evenly balanced ionization distribution throughout the cabinet. There is therefore a need for a new and improved cabinet in which hot spots do not develop within the cabinet.

In general it is an object of the present invention to provide a storage cabinet and method for preventing electrostatic charge buildup within the cabinet.

Another object of the invention is to provide a storage cabinet and method of the above character in which hot spots within the cabinet are eliminated.

Another object of the invention is to provide a storage cabinet and method of the above character in which a freeboard space is utilized to achieve a substantially uniform or evenly balanced ionization distribution within the cabinet and within separate compartments in the cabinet.

Another object of the invention is to provide a storage cabinet and method of the above character which is particularly suitable for the storage of photomask reticle cassettes in which a freeboard space is provided to move air over, around and underneath the cassettes.

Another object of the invention is to provide a storage cabinet and method of the above character in which the freeboard space is utilized to sweep any particles out of the cabinet.

Another object of the invention is to provide a storage cabinet and method of the above character in which filtering is provided.

Another object of the invention is to provide a cabinet and method of the above character in which pulse DC ionization is utilized to neutralize static buildup.

Another object of the invention is to provide a cabinet and method of the above character in which a high voltage, as for example, 5000 volts of DC static buildup can be neutralized throughout the cabinet within a short period of time.

Another object of the invention is to provide a cabinet and method of the above character which permits an uninterrupted flow of ions throughout the cabinet and around the articles stored in the cabinet.

Another object of the invention is to provide a cabinet and method of the above character in which a nitrogen enriched atmosphere is provided.

Another object of the invention is to provide a cabinet which has a removable back to permit easy access to the ionization devices utilized.

Additional objects and features of the invention will appear from the following description in which the preferred embodiments are set forth in detail in conjunction with the accompanying drawings.

Figure 1:
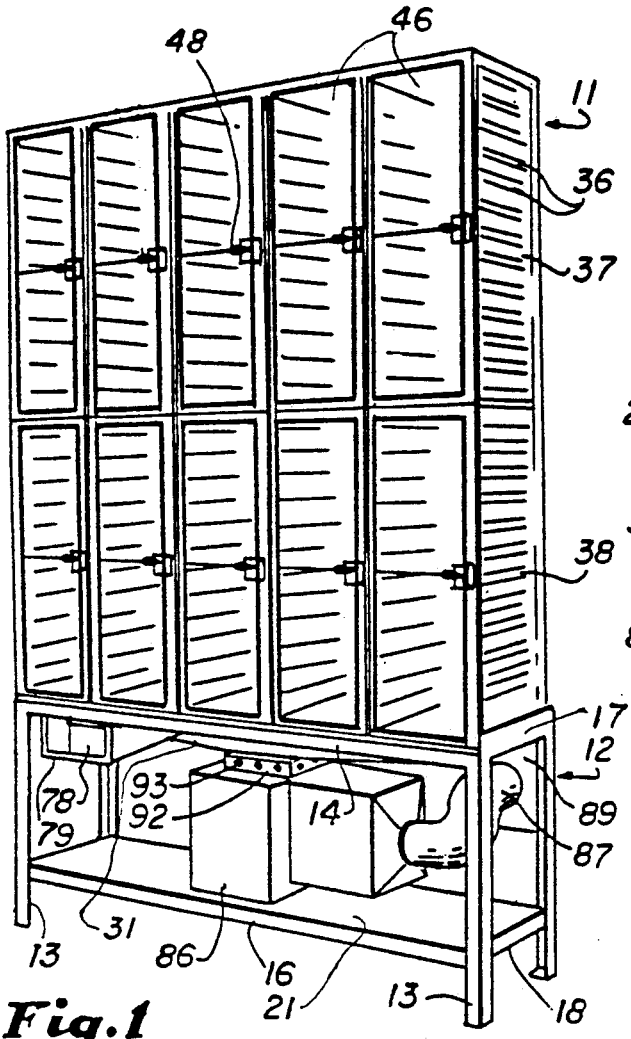
FIG. 1 is a perspective view of a photomask reticle storage cabinet incorporating the present invention.
Figure 2:
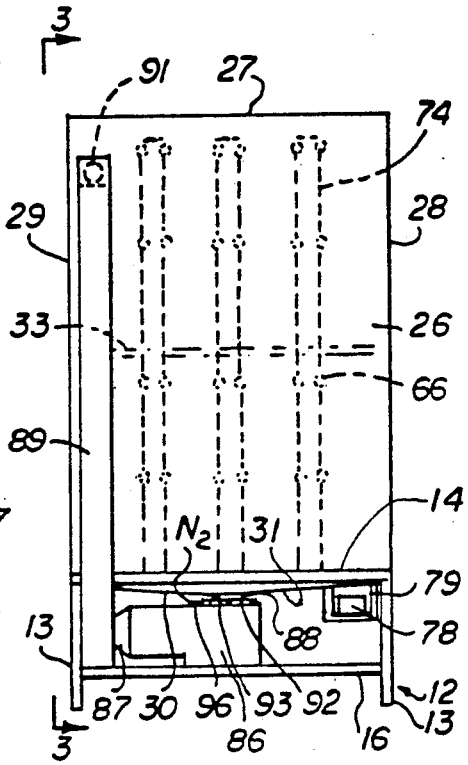
FIG. 2 is a rear elevational view of the cabinet shown in FIG. 1.
Figure 3:
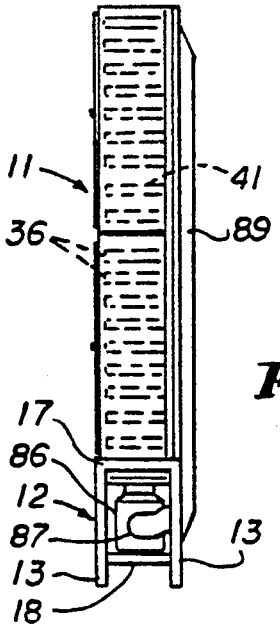
FIG. 3 is a side elevational view of the cabinet shown in FIG. 2 looking along the line 3—3 of FIG. 2.
Figure 4:
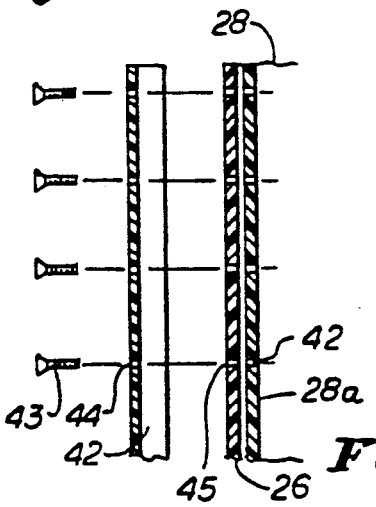
FIG. 4 is a partial cross sectional exploded view showing the attachment of the rear wall.
Figure 5:
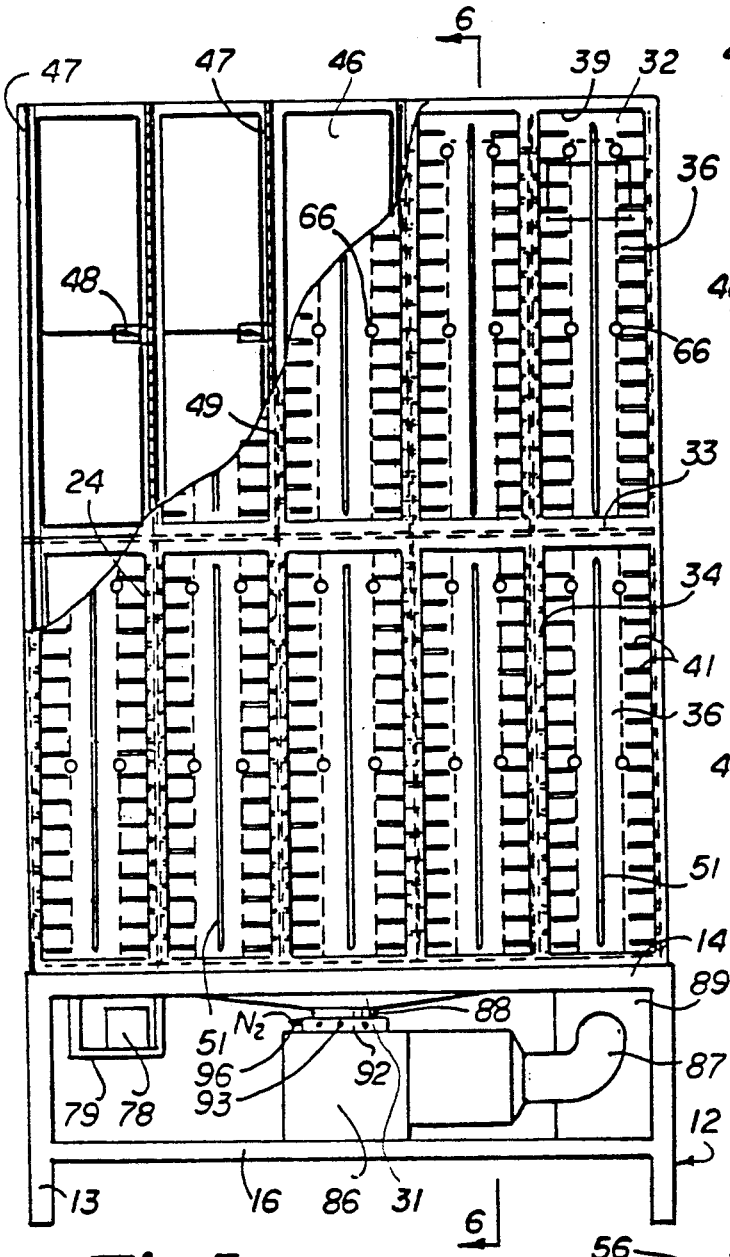
FIG. 5 is a partial front elevational view partially in cross section of the cabinet shown in FIG. 1.
Figure 6:
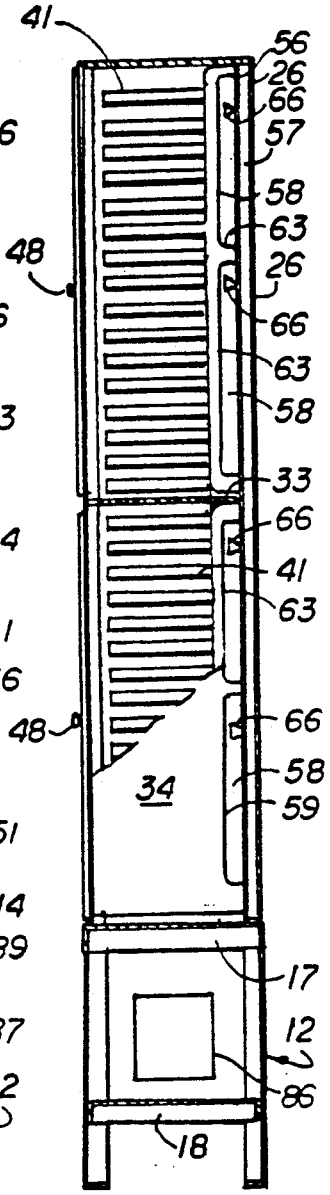
FIG. 6 is a partial side elevational view partially in cross section of the cabinet shown in FIG. 1.

In general, the storage cabinet for preventing electrical charge buildup with filtering of the present invention is comprised of a box-like housing forming an enclosure and having wall means within the enclosure forming a plurality of cells. Each of the cells has an opening. A door is provided for closing each opening and for providing access to the cells. Shelf means is provided within each of the cells for receiving and carrying discrete articles which are introduced into the cells through the doors. The shelf means in the cabinet is positioned to provide a freeboard space extending vertically of the cabinet on one side of the articles. A plenum wall extends vertically in the cabinet between the freeboard space and the housing to provide a vertically extending plenum. Means is provided for collecting air from within the enclosure in the cabinet and for supplying it to the plenum at a positive pressure. The means for supplying air includes means for introducing makeup air and nitrogen into the plenum. Pairs of ionization emitters are mounted on the plenum wall and face into the freeboard space and emit positive and negative ions into the freeboard space. The ionization emitters are spaced across the plenum wall and are positioned near the upper extremity of the plenum wall.

More particularly, as shown in the drawings, the cabinet 11 for preventing electrostatic charge buildup with filtering is shown in FIGS. 1–8. The cabinet 11 is mounted upon a support stand 12. The support stand 12 is comprised of four legs 13 disposed on the four corners of the support stand. Upper and lower horizontal front and, rear cross members 14 and 16 extend between the legs 13 as do upper and lower side cross members 17 and 18. A board or platform 21 is supported by the lower cross members 16 and 18 and serves as a support for a purpose hereinafter described. The cabinet 11 is mounted on the upper horizontal cross members 14 and 12 and is supported thereby.

The cabinet 11 is in the form of a rectangular box-like housing and is provided with vertical front and rear walls 24 and 26, a horizontal top wall 27 which adjoins the rear wall 26 and spaced apart parallel vertical side walls 28 and 29 which adjoin the rear wall 26 and the top wall 27. The bottom of the cabinet is open and is in communication with a space 30 above a plenum forming member 31 which is mounted in the top horizontal cross members 14 and 17. The walls of the cabinet 11 are typically formed of a clear or transparent material so that the articles such as photomask reticle cassettes stored therein can be readily observed as hereinafter described. A clear acrylic has been found to be a particularly suitable material because it is easier to fabricate the cabinet utilizing such a material. It is also a clean material, that is, it does not outgas during use of the same.

The interior space in the cabinet 11 is provided with interior horizontal and vertical walls or partitions 33 and 34 to form a plurality of rectangular cells 36. For example, ten of such cells 36 are shown in the cabinet 11 in the drawings with five cells 36 in a top row 37 and five cells in a bottom row 38. Cells 36 are accessible through openings 39 provided in the front wall 24. These partitions 33 and 34 also can be formed of a suitable material, preferably transparent such as acrylic plastic.

By way of example, as hereinafter described, each of the cells can be provided with cassette storage means for storing a predetermined number of cassettes, as for example, 200 cassettes in which 20 cassettes would be stored in each cell. The size of the cells and the number of cassettes stored in each cell can be predetermined. It is often desirable to select the number of cassettes for each cell to correspond to the number of masks required for making a single layer on a semiconductor device. Thus, for example, 10, 12, 14, 16 or 18 masks can be utilized for each layer of a semiconductor device to make it desirable to provide cells which will store all of the masks for making a single layer in a semiconductor device. This makes it possible to store the masks for one complete run in one section as for example, one cell in the cabinet.

Figure 7:
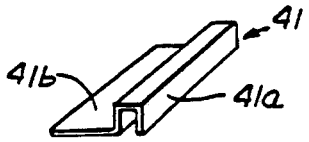
FIG. 7 is an isometric view of one of the slide rails used in the cabinet shown in FIG. 1.

Means is provided for supporting photomask reticle cassettes within the cells 36 and is comprised of a plurality of vertically spaced horizontally disposed slide rails or cassette support members 41 provided in each of the cells 36 for supporting the cassettes within the cells. These slide rails or support members 41 are also formed of a suitable transparent material such as acrylic. One of the slide rails or support members 41 is shown in FIG. 7 and as shown therein, it is comprised of a U-shaped portion 41*a* and a planar horizontal portion 41*b* on which the cassette is to rest. The U-shaped the rail. The U-shaped portion 41*a* can be secured to the side walls 28 and 29 and the vertical partitions 33 by suitable means such as an adhesive. The slide rails 41 are spaced apart vertically and are aligned horizontally so that the rails 41 on opposite sides of a cell are at the same levels. The slide rails 41 provided in this manner are capable of each supporting approximately 20 pounds each whereas the loading provided by a typical cassette should be less than approximately 1½ pounds. The U-shaped portion 41*a* of the rail 41 in addition to giving additional strength to the slide rail 41 also serves to provide spacing between the cassettes supported on the slide rail 41 and the side wall of the cell. The use of such a slide rail 41 also makes it possible to accommodate various sizes and heights of cassettes. The slide rails or support members 41 provide support for a plurality of cassettes in each cell, as for example, 10 to 16 as shown in the drawings.

In order to provide access to the rear of the cabinet, the rear wall 26 can be formed as a removable back 26 by providing a flange portion 28*a* (see FIG. 4) on the side wall 28 and the corresponding flange on the side wall 29. The back wall 26 is secured to these flanges 28 in a suitable manner such as utilizing a metal angle member 42 with screws 43 that extend through holes 44 provided in the angle member 38 and through holes 45 provided in the back member 26 and which is threaded into threaded bores 42 provided in the flanged portion 28*a* and the corresponding flange (not shown) on the side wall 29.

A hinged door 46 is provided for closing the access opening 32 for each of the cells. The door is formed of a suitable transparent material such as an acrylic and is mounted by a metal piano-type hinge 47 to the front wall 24 so that the doors can swing about a vertical axis. A casement or twist metal latch 48 is provided for each of the doors 46. A door seal 49 of a suitable type is placed on the door or on the cabinet and is adapted to form a fluid-tight seal between the exterior ambient atmosphere surrounding the cabinet 11 and the interior of the cabinet 11. For example, Ryton door seals utilizing a closed cell material have been found to be satisfactory for this purpose. The metal door latches 48 and the metal hinges 47 for the doors 46 are grounded to prevent static buildup in the same. Each of the doors 46 is provided with a reinforcing strip which extends vertically of the door and is formed of a suitable material such as acrylic to prevent bowing of the door.

A plenum wall 56 is mounted within the cabinet 11 and is parallel to the rear wall 26 but is spaced therefrom to provide a vertically extending plenum 57 extending from the bottom of the cabinet to the top wall 27 of the cabinet. This plenum wall 56 can also be formed of a suitable transparent material such as acrylic and can have a suitable thickness as for example, ¼ of an inch. The plenum 57 is in communication with the space within the plenum 31 provided at the bottom of the cabinet 11. The plenum wall 56 is spaced a predetermined distance behind the slide rails 41 as, for example, a distance of two and one-half inches to provide a freeboard space 58 which extends vertically of the cabinet 11 behind all of the cells 36. The partitions or dividers 33 and 34 are secured to the plenum wall 56 by suitable means such as an adhesive and are provided with spaced apart elongate cutouts 59 to provide free circulation of air in the freeboard space 58. The plenum wall 56 is perforated with a plurality of holes 61 (see FIG. 8) so that nitrogen enriched air can flow from the plenum 57 into the freeboard space 58 and into the cells 36 of the cabinet 11. The holes 61 can have a suitable size as ⅛" in diameter and are spaced apart a suitable distance as, for example 6". Preferably the holes 61 should be no larger than ⅛" in diameter. Also the holes 61 are tapered outwardly through the backside of the plenum wall 56 to eliminate the whistling effect that is common with holes drilled that are not countersunk.

A vertical stop 62 is provided for each of the cells 36 and is secured to the plenum wall 56 by suitable means such as an adhesive along a line which is substantially equidistant from the sides of the cell. The stops 62 are formed of a suitable material such as a clear acrylic. The stops 62 are each provided with a pair of cutouts 63 which are approximately 1½" in depth and 6–8" in length which are spaced apart vertically of the stop. The stops 62 are of a suitable depth as, for example, 2" to prevent cassettes 64 placed in the cells 36 from being pushed into the freeboard space 58 and interfering with the free flow of air in the freeboard space.

The U-shaped slide rail portions 41*a* permit free airflow from the back of the cabinet to just within ¾" of the front of the cabinet. This creates a backflow type of air turbulence between the cassettes 64. In effect this causes the air to sweep across the undersides of the cassettes 64 and back to the freeboard space 58 whenever a cassette is inserted. Without this feature there would not be a return air stream to the freeboard space. The holes 61 in the plenum wall 56 with the 6" spacing therebetween provide a pattern which will cause an airflow from the plenum 57 to wash across the tops of the cassettes 64.

A plurality of ionization emitters 66 are also mounted on the plenum wall 56. The ionization emitters can be of a suitable type such as those supplied by Static Control Services, Inc., 870 Research Drive, Building 9, Palm Springs, California 92262. Such ion emitters are provided with a cone-shaped portion 67 which is provided with thoriated tungsten electrode 68. The conical member 67 is provided with threads 69 permitting it to be threaded into threaded bores 71 provided in the plenum wall 56 so that the ionization emitters 66 extend into the freeboard space 58 provided between the plenum wall 56 and the rear extremities of the slide rails 41. A cap 72 which forms a part of the ionization emitters 66 is disposed on the rear side of the plenum wall 56 and is also threaded onto the threads 69 of the conical part 67 so that the ionization emitter 66 is affixed to the plenum wall 56 and also so that a sharpened pin 73 can puncture and come into contact with an insulated wire 74 extending through a hole 76 in the cap 72.

The wires 74 extend in the plenum chamber 57 and interconnect the ionization emitters 66 to a power supply 78 of a conventional type, such as one supplied by the manufacturer of the ion emitters Static Control Services, Inc., hereinbefore above. In such a power supply, two independent DC power supplies are provided to generate both the positive and negative ions. The power supply switches back and forth between the positive and negative supplies by utilizing a multi-vibrator control circuit. The positive and negative power supplies use separate electrodes to generate the positive and negative ions. Alternative waves of ions generated by the ionization emitters are generated by allowing enough time for this space charge to spread the ions. Positive and negative ions intermix as they move away from the electrodes by their attractive forces. The power supply 78 can be mounted in any suitable location on the cabinet, for example, it can be provided immediately below the cabinet by mounting it in a U-shaped bracket 79.

In accordance with the present invention it has been found desirable to place the ionization emitters in predetermined locations in the cabinet. Thus with a cabinet of the size shown in the drawings, as for example, having a width of approximately 48 inches and a height of approximately 66 inches. The rear wall of the cabinet is split into thirds with six pairs being provided in the top half or the top five cells of the cabinet and another six pairs in the bottom half or bottom five cells of the cabinet. A pair of emitters (one positive and one negative) is mounted in each of the thirds of the cabinet, approximately three and one-half inches from the top of the cabinet so that three ionization pairs are located three and one-half inches across the top of the cabinet with the pairs being spaced apart approximately 12" from each other pair and from the side walls 27 and 28 of the cabinet 11. Three additional pairs of emitters are located in the same thirds, approximately 12–14" down from the other pairs of emitters or approximately 15 to 17½" from the top of the cabinet. The horizontal spacing is the same as for the top row of emitters.

The same type of placement is utilized for the bottom half of the cabinet in which the first three pairs are mounted 3½" from the top of the bottom half of the cabinet and the other three pairs of emitters are mounted 12–14" below that with the same horizontal spacing. It has been found that the hereinbefore described arrangement of emitters is able to provide a cabinet which has substantially uniform ionization throughout that is free of hot spots. No section of the cabinet 11 reaches a static voltage in excess of 500 volts and that the decay times are always under two minutes in any location in the cabinet.

Figure 8:
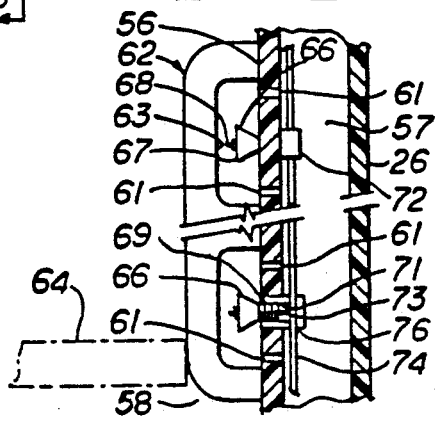
FIG. 8 is a cross-sectional view of a portion of the cabinet shown in FIG. 1 showing the manner in which an ionization emitter is mounted on the plenum wall of the cabinet.

As hereinbefore described, the stops 62 have been provided in the rear extremity of the cabinet to prevent the cassettes placed in the cabinet from sliding all the way back to the plenum wall 56 to protect the freeboard space which is desired. By maintaining a two inch freeboard space, it has been found that any tendency to charge the cassettes in the cabinet is overcome. It may be desirable to increase this freeboard space in certain applications to approximately 4½". This freeboard space 58 also serves as a mixing chamber which permits the ions to flow around the dividing walls that are in the cabinet which provide the cells 36. The rear extremities of the cells 36 open into the freeboard space 58 and this permits gas to flow from one cell to the next. The cutouts 63 in the stops 62 are positioned to permit ions emitted from the emitters 66 to flow freely sideways and forwardly into the freeboard space 58. As shown in FIG. 8, the emitters 66 are centered vertically with respect to the cutouts 63. In this way it has been found that it is possible to achieve substantially uniform deionization in all of the cells 36 and in the cabinet 11 to eliminate the possibility of hot spots being created in any of the cells 36.

An in-line filter blower unit 86 of a conventional type is mounted on the platform or shelf 21. A suitable filter blower is supplied by the Aluminum Filter Company located at 1000 Cind Lane, Carpenteria, Calif. 93013. It is a filter blower unit which supplies air that is particulate free (down to 1.2 microns). The filter blower unit consists of 1 H.E.P.A. filter, one cleanable free filter and one blower housed in a plastic container. It is provided with an outlet 87 and an inlet 88. The inlet 88 is connected to the plenum member 31. Air in the cabinet flows down through the cabinet 11 and into the plenum 30 formed by the plenum member 31 and into the inlet of the filter blower unit 86 which supplies nitrogen enriched air through the outlet 87 into a rectangular air channel member 89 which extends up the back side of the rear wall 26. The channel member 89 directs filtered air into an opening 91 provided at the top of the back member 26 and into the top of the cabinet 11. The air channel member or track 89 can be formed of a suitable material such as clear acrylic and can have a suitable dimension as, for example, 4–6" in width and a depth of approximately 2" running almost the entire height of the cabinet 11. In order to provide adequate recirculation it has been found desirable to utilize 130 cfm blower.

A collar 92 is provided between the inlet 88 and the plenum member 31. The collar 92 is provided with a plurality of holes 93 around its perimeter which have been provided to bring in outside ambient air so as to prevent the air within the cabinet becoming static. In addition, nitrogen is introduced into a fitting 96 provided on the collar 92 so that nitrogen is mixed with the makeup air and with the air coming from the bottom of the cabinet and before passing through the filter and blower unit 86. The nitrogen can be supplied from any conventional source.

Although, as shown, the outside air which is brought into the collar 92 is from the ambient air within the room in which the cabinet is positioned, it should be appreciated that if desired, the air supplied can be supplied independently of the room air, as for example, from an external filtering system provided for a building in which the cabinet is located. In such a case air can be supplied through ducting provided in the walls of the building and then connected to the in-line filter blower unit 86 in an appropriate manner.

The filter blower unit 86 creates a positive air pressure within the cabinet which is greater than the pressure of the air within the room in which the cabinet is located. This ensures that when a door 46 to a cell 36 is opened, the positive pressure present within the cell creates an outgoing flow of air through the door opening 39 which can be called an air curtain that prevents the sucking in of ambient unfiltered air into the cabinet. This prevents the sucking in of particles from the ambient air when a door is opened and closed.

The cabinet 11 hereinbefore described can be utilized for the storage of photomask or reticle cassettes as, for example, 120 cassettes with the size of the cabinet shown in the drawings. Pulse DC ionization is used on the cabinet to neutralize static buildup. Typically a 5000 volt static DC buildup can be neutralized throughout the cabinet at approximately 35 seconds without any remaining hot spots. The unique freeboard space design provided to the rear of the cassettes provides an uninterrupted flow of ions throughout the cabinet and around the cassettes. The filtration system provided permits particle control within the cabinet. The 300 cubic feet per minute in-line blower filter 86 ensures that a positive pressure is created at all times in the cabinet so as to prevent outside ambient air from entering the cabinet when one or more of the doors are opened. Nitrogen is injected into the system through the return plenum which allows prefiltering of the nitrogen. The back is removable to permit ready access to the ionization emitters and the wiring therefore.

Although the cabinet shown in the drawings provides horizontal storage for the cassettes, it should be appreciated that, if desired, the cabinet can be arranged to provide vertical storage of the cassettes merely by changing the orientation of the slide rails 41 by 90° so that they would be mounted on the top and bottom walls of each cell rather than on the side walls. In such an arrangement it is necessary to provide more horizontal dividers with one horizontal divider for each row of cassettes. In order to increase the movement of air sweeping over the cassettes so that the air can move from back to front and down, slots (not shown) can be provided in the horizontal dividers adjacent the doors of the compartments. Downward movement of the air can also be achieved by placing additional slots or holes in the horizontal dividers. In this way a return air plenum can be provided at the bottom of the cabinet rather than at the rear as shown.

It also should be appreciated that if there is inadequate space for separate blower and filter unit, that the height of the cabinet can be reduced and the plenum 31 can be directly connected to a building filtration system having a service alley. A H.E.P.A. filter can be installed in the service alley to provide remote filtration for the air being recirculated through the cabinet.

What is claimed is:

1. In a storage cabinet for discrete articles for preventing electrical charge buildup with filtering, a box-like housing forming an enclosure and having front and rear walls and side walls, divider walls within the enclosure forming a plurality of cells, each of the cells having an opening facing forwardly from the rear wall, said front wall having openings therein in registration with the openings in the cells, an openable door closing each of said openings in said front wall and permitting access to the cell, shelf means provided within each of the cells for receiving and carrying discrete articles which are introduced into the cells through the openable doors, plenum wall means extending vertically in the rear of the enclosure and spaced forwardly of the rear wall of the enclosure to provide a plenum, spacer means in the enclosure providing a freeboard space extending across said rear wall of the enclosure on one side of the shelf means adjacent the plenum wall means, said spacer means including stop means located in the freeboard space for preventing articles entering the freeboard space, blower and filter means for collecting air from within the enclosure in the cabinet and for supplying filtered air to the plenum and into the freeboard space at a positive pressure, pairs of ionization emitters mounted on said plenum wall means and facing inwardly into the freeboard space to emit positive and negative ions into the freeboard space and power supply means for supplying power to the ionization emitters.

2. A storage cabinet as in claim 1 wherein said blower and filter means for collecting air includes means for introducing makeup air and nitrogen into the plenum.

3. A storage cabinet as in claim 1 wherein ionization emitters are spaced across the plenum wall means and are positioned near one extremity of the plenum wall means and additional ionization emitters spaced across the plenum wall means and spaced a predetermined distance away from the first named ion emitters.

4. A storage cabinet as in claim 1 wherein upper and lower rows of cells are provided and wherein a horizontal row of ionization emitters are formed near the top extremity of the cells and another row of ionization emitters is provided approximately midway of the height of the cabinet.

5. A storage cabinet as in claim 1 wherein said ionization emitters are in the form of pairs of ionization emitters with each pair having one ionization emitter which generates positive ions and the other ionization emitter of the pair generating negative ions.

6. A storage cabinet as in claim 1 wherein said walls are formed of a clear material.

7. A storage cabinet as in claim 6 wherein said clear material is a clear plastic.

8. A storage cabinet as in claim 1 wherein said blower and filter means is in the form of an in-line blower and filter.

9. A storage cabinet as in claim 8 together with a stand for supporting said storage cabinet in a spaced position above the floor and wherein said in-line blower and filter is mounted below the cabinet.

10. A storage cabinet as in claim 1 wherein said means for supplying filtered air to the plenum includes ducting for supplying air to the plenum near the top of the plenum.

11. In a storage cabinet for discrete articles for preventing electrical charge buildup with filtering, a box-like housing forming an enclosure and having front and rear walls and side walls, divider walls within the enclosure forming a plurality of cells, each of the cells having an opening facing forwardly from the rear wall, said front wall having openings therein in registration with the openings in the cells, an openable door closing each of said openings in said front wall and permitting access to the cell, shelf means provided within each of the cells for receiving and carrying discrete articles which are introduced into the cells through the openable doors, plenum wall means extending vertically in the rear of the enclosure and spaced forwardly of the rear wall of the enclosure to provide a plenum, spacer means in the enclosure providing a freeboard space extending across said rear wall of the enclosure on one side of the shelf means adjacent the plenum wall means, said spacer means including stop means located in the freeboard space for preventing articles entering the freeboard space, blower and filter means for collecting air from within the enclosure in the cabinet and for supplying filtered air to the plenum and into the freeboard space at a positive pressure, pairs of ionization emitters mounted on said plenum wall means and facing inwardly into the freeboard space to emit positive and negative ions into the freeboard space, power supply means for supplying power to the ionization emitters and removable means for securing said rear wall to the side wall so that the rear wall can be removed to permit access to the plenum wall means and the ionization emitters mounted thereon.

12. In a storage cabinet for discrete articles for preventing electrical charge buildup with filtering, a box-like housing forming an enclosure and having front and rear walls and side walls, divider walls within the enclosure forming a plurality of cells, each of the cells having an opening facing forwardly from the rear wall, said front wall having openings therein in registration with the openings in the cells, an openable door closing each of said openings in said front wall and permitting access to the cell, shelf means provided within each of the cells for receiving and carrying discrete articles which are introduced into the cells through the openable doors, plenum wall means extending vertically in the rear of the enclosure and spaced forwardly of the rear wall of the enclosure to provide a plenum, spacer means in the enclosure providing a freeboard space extending across said rear wall of the enclosure on one side of the shelf means adjacent the plenum wall means, said spacer means including stop means located in the freeboard space for preventing articles entering the freeboard space, blower and filter means for collecting air from within the enclosure in the cabinet and for supplying filtered air to the plenum and into the freeboard space at a positive pressure, pairs of ionization emitters mounted on said plenum wall means and facing inwardly into the freeboard space to emit positive and negative ions into the freeboard space and power supply means for supplying power to the ionization emitters, said shelf means including means within the storage cabinet for providing shelves in each of the cells for holding a plurality of photomask reticle cassettes.

13. A storage cabinet as in claim 12 wherein said stop means includes means within each cell for preventing the cassettes from being pushed into the freeboard space so as to permit the free circulation of air in the freeboard space between the cells and between the cassettes within the cells.

14. A storage cabinet as in claim 13 wherein said shelves are in the form of spaced apart parallel members having planar horizontally extending portions and a U-shaped channel formed integral therewith to provide rigidity and means for securing the U-shaped channel to the walls forming the cells.

15. In a method for preventing electrical charge buildup on photomask reticle cassettes stored in cells within a storage cabinet, providing a freeboard space in the cabinet extending across the cabinet on one side of the cells and opening into the cells, preventing the cassettes in the cells from entering the freeboard space, supplying filtered air to the freeboard space and introducing positive and negative ions into the freeboard space in a region near one end portion of the freeboard space.

16. A method as in claim 15 together with the step of introducing additional ions into the freeboard space which is substantially equidistant from said one end portion of the freeboard space and the other end portion of the freeboard space for the cell.

17. A method as in claim 16 wherein the ions are introduced in regions which are spaced apart in one direction of the cabinet.

* * * * *